US005415568A

United States Patent [19]

Kinoshita

[11] Patent Number: 5,415,568

[45] Date of Patent: May 16, 1995

[54] ELECTRICAL CONTACT AND ELECTRICAL CONNECTOR USING SUCH CONTACT

[75] Inventor: Yoshiji Kinoshita, Kawasaki, Japan

[73] Assignee: The Whitaker Corporation, Wilmington, Del.

[21] Appl. No.: 75,186

[22] Filed: Jun. 9, 1993

[30] Foreign Application Priority Data

Jul. 16, 1992 [JP] Japan ..... 4-210649

[51] Int. Cl.[6] ..... H01R 13/648

[52] U.S. Cl. ..... 439/610; 439/98; 439/885

[58] Field of Search ..... 439/98, 607, 609, 610, 439/885, 736, 855, 721, 723, 907; 29/874

[56] References Cited

U.S. PATENT DOCUMENTS

| | | | |
|---|---|---|---|
| 3,153,840 | 10/1969 | Vincent | 29/874 |
| 3,693,139 | 9/1972 | Assmus et al. | 439/848 X |
| 4,255,010 | 3/1981 | Jullien | 439/655 |
| 4,884,981 | 12/1989 | Chandler et al. | 439/610 |
| 5,059,140 | 10/1991 | Philippson et al. | 439/610 X |
| 5,145,386 | 9/1992 | Berg et al. | 439/83 |

FOREIGN PATENT DOCUMENTS 1326018 3/1994 United Kingdom .

*Primary Examiner*—Eugene F. Desmond

*Attorney, Agent, or Firm*—Adrian J. La Rue; Mary K. Van Atten

[57] ABSTRACT

The purpose of the present invention is to provide an electrical contact that can be manufactured efficiently from narrow metal strips and an electrical connector for LANs etc. which uses such a contact.

Electrical connector 10 includes an insulation housing 20 with one pair of compartments 21 and 22. A pair of electrical contacts 31 and 32 have tab contact sections 33 which extend through the rear wall of housing 20 into compartments 21 and 22. The tab contact sections **33*a*–33*b*, and 33*c*–33*d* of contacts 31 and 32 respectively are separate and parallel with respect to each other. They are connected at coupling sections 35, 36 and each has a connection terminal 37 and 38. The outer sections of coupling sections 35 and 36 are twisted in the fabrication process so that the tab contact sections of both contacts 31 and 32 are reversed up or down with respect to each other so that the tab contact sections 33*a*–33*d* are disposed in the same plane in compartments 21, 22**.

13 Claims, 4 Drawing Sheets

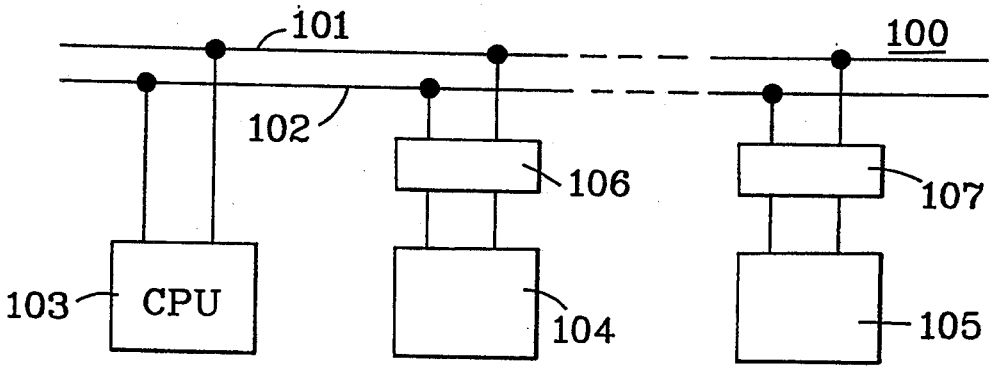
Fig. 5A
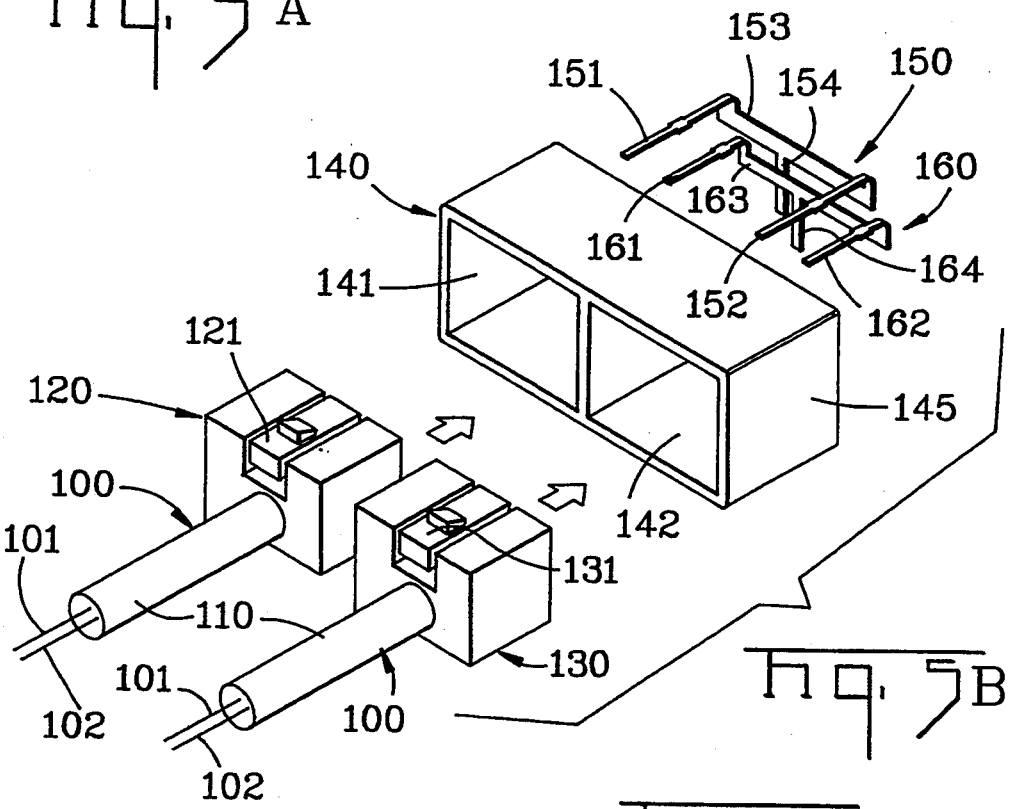
Fig. 5B
Fig. 5C
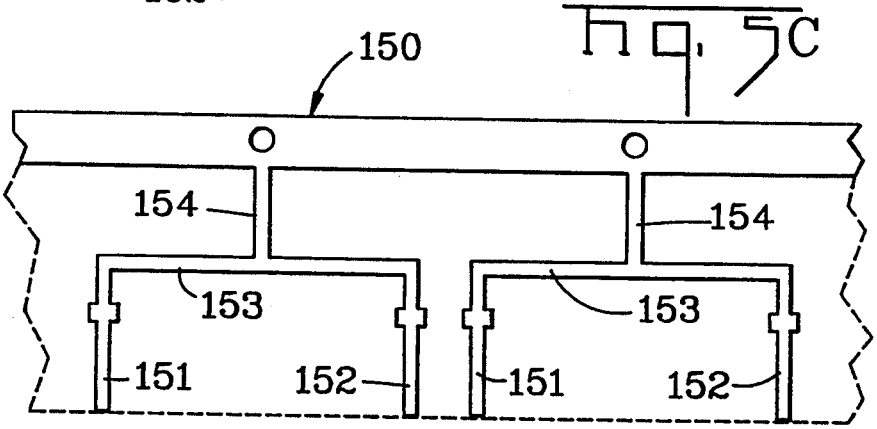

ELECTRICAL CONTACT AND ELECTRICAL CONNECTOR USING SUCH CONTACT

FIELD OF USE

The present invention concerns electrical contacts and electrical connectors which utilize these contacts, particularly those which employ two or more tab contacts to make a connection.

BACKGROUND OF THE INVENTION

In offices, homes, automobiles and in other locations or equipment which use advanced electronics, one or more central processing unit devices (CPU) or microprocessors (MPU) are employed. Local area networks (LAN) are used to interconnect these processors and related peripheral devices.

In order to interconnect the peripheral devices and the LAN data bus, a large number of I/O (input-output) connectors are used. One example of this type of I/O connector is that described in Japanese Patent Application No. 407169 [1990]. This type of connector is explained briefly below with reference to FIG. 5.

As shown in FIG. 5A, the data bus of LAN 100 has two main paths or conductors 101 and 102 and, in this instance, CPU 103 is connected to it. Peripheral devices 104 and 105 are selectively connected to bus conductors 101, 102 via I/O connectors 106 and 107, respectively.

The I/O connectors 106, 107 used with this LAN 100 could be configured as shown, for example, in FIG. 5B. Data bus 100 is configured with conductors 101, 102 in the form of shielded cable 110. Plug connectors 120, 130 are connected at fixed positions to the cables. Although not shown in the figure, each plug connector 120, 130 has two receptacle contacts and each is connected to signal conductors 101, 102 of the shielded cable 110. These plug connectors 120, 130 can be inserted into the plug connector compartments 141, 142 of the cap connector 140. Latch arms 121, 131 formed on each of the plug connectors 120, 130, latch with and are fixed in the latch sections (not shown in the figure) in the inner walls of the compartments 141, 142 of the cap connector 140. The latches may be formed, for example, as disclosed in Japanese Patent Publication NO. 3-50622 [1992].

A pair of mutually linked contacts 150, 160 includes two pairs of tab contact sections 151, 152 and 161, 162 which extend into compartments 141, 142 from the rear of cap connector 140. Each of the contacts 150, 160 have connection terminals 154, 164 extending downward from the central portion of the coupling sections 153, 163 which connect the tab contacts. These connection terminals 154, 164 are connected to peripheral devices 104, 105 by, for example, being soldered to a printed circuit board. Of course, if necessary, the insulation housing 145 of cap connector 140 can be fixed to the above noted circuit board by a screw or other such mounting hardware.

In the I/O connector system shown in FIG. 5B, the shielded conductive wires 101, 102 form the continuous data bus 100 in FIG. 5A by connecting with the shielded conductors 101, 102 of plug connectors 120, 130 via the contacts 150, 160 of cap connector 140. It is also easy to see how it is possible to simultaneously use connection terminals 154, 164 of the contacts 150, 160 of cap connector 140 to configure a tap or shunt in order to connect peripheral devices 104, 105 with data bus 100.

Electrical contacts for electrical connectors are generally manufactured by a process of stamping metal sheets usually made of a copper alloy. With prior techniques, in order to obtain the contacts 150, 160 described above with a process of stamping them from strips of metal sheets, a large metal strip of sufficient width has to be used to stamp out the tab portions 151, 152 (161, 162), the coupling sections 153 (163), and the connection terminals 154 (164). Subsequently the connection terminal section 154 (164) is twisted along with the main section to form the final contact 150 (160). However, as is evident in FIG. 5, when forming contact 150 (160) this stamping process when used with previous technology has the disadvantage of requiring the scrapping of a large portion of the metal strip and consequent high cost caused by this poor efficiency in the utilization of materials.

Consequently, the purpose of the present invention is to provide an electrical contact that can be manufactured efficiently and inexpensively using extremely narrow metal strips and forming the contacts from these metal strips with the previously noted stamping process.

Furthermore, an additional purpose of the present invention is to provide an electrical connector that can be used effectively with LANs such as described above where multiple electrical contacts such as described above are utilized.

SUMMARY OF THE INVENTION

In order to resolve the problems noted above, the electrical contact of the present invention comprises a pair of tab contacts arranged approximately parallel to and separated from each other, a coupling section joining each pair of tab contacts at their rear edge, and a connection terminal section fabricated at about the middle of the coupling section, the whole contact being formed in one unit from a metal sheet with the tab contact portions twisted at both ends of the coupling section.

Further, the electrical connector of the present invention is comprised of an insulation housing having a pair of compartments for holding a pair of inserted plug connectors and equipped with a pair of contacts each having a pair of joined tab contact sections extending into each of the compartments from the rear of the insulation housing. The tab contact sections of the two contacts are twisted in opposite directions, one up and one down, so as to be aligned in approximately the same plane.

BRIEF DESCRIPTION OF THE DRAWINGS

The invention will now be described by way of example with reference to the accompanying drawings in which:

FIG. 3 is an exploded perspective view showing the manufacturing steps for making a plug connector that can be used in conjunction with the electrical connector shown in FIG. 1.

FIGS. 5A–C show a LAN configuration in which the electrical connector of the present invention can be used, a prior art connector and the manufacturing steps for the contacts used with such connector.

DETAILED DESCRIPTION OF THE INVENTION

Figure 1:
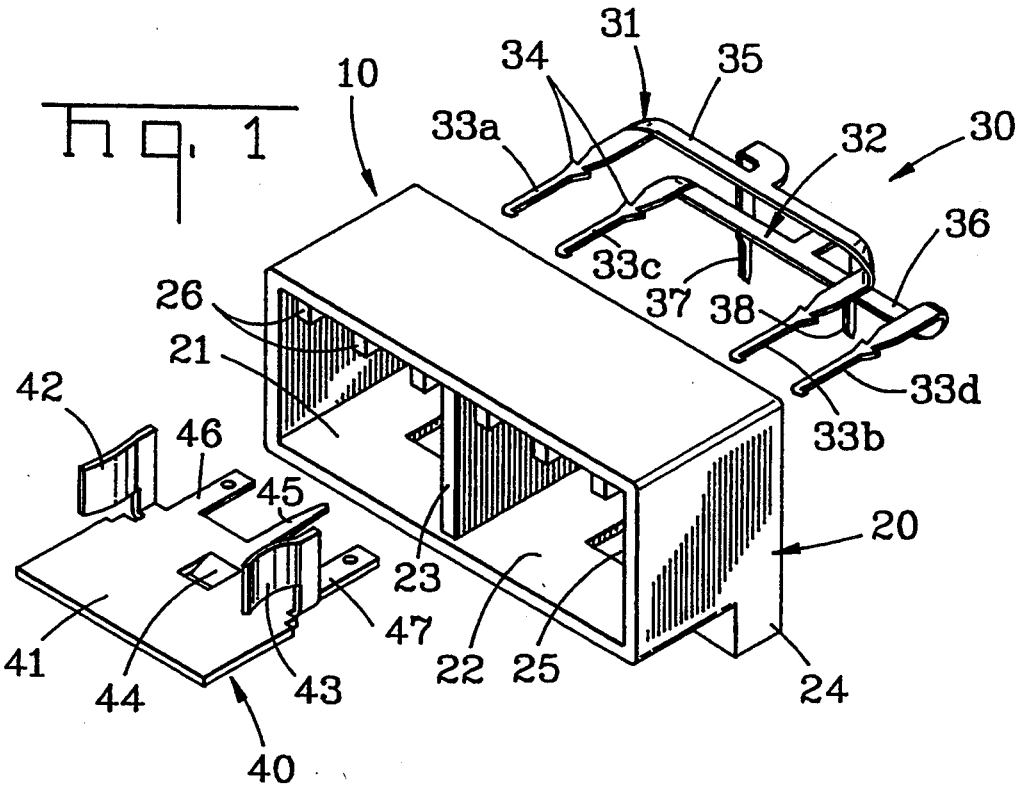
FIG. 1 is an exploded perspective view showing a practical example of the electrical connector of the present invention.

FIG. 1 is a perspective view of a suitable practical example of an electrical connector according to the present invention, in this case describing the cap connector described above. As is evident in FIG. 1, the electrical connector 10 of the present invention is composed of a cap housing 20, terminals 30 inserted from the rear and held by housing 20, and grounding contact 40 inserted and fixed within housing 20. Cap housing 20 is open toward the front and includes a pair of plug receptacle compartments 21, 22 separated by central dividing wall 23. The cap connector also has standoff or leg 24 to facilitate placement of the lower surface on, for example, a printed circuit board (not shown) and fixing apertures 25 for securing grounding contact 40 in each compartment 21, 22. In addition, the upper inner walls of each compartment 21, 22 of cap housing 20 are furnished with spaced projections 26 (the example in the figure has three) formed to extend from front to back and designed to function as guides to prevent misalignment when plug connectors, described below, are inserted.

Next, as shown in FIG. 1, terminal 30 is comprised of a pair of contacts 31, 32 each with a pair of parallel and separated tab contacts 33*a* to 33*d*. In approximately the central part of the tab contacts 33*a* to 33*d* of these contacts 31, 32, there are projecting barbs 34 which serve to hold the contacts firmly in place when they are inserted in the holes furnished in the rear wall of cap housing 20. The tab contacts 33*a*–33*b* of one of the contacts 31 is joined by coupling section 35 and are twisted in a downward direction on both sides to form a signal unit. In addition, solder connection terminal 37 which extends out and to the left from the center rear of coupling section 35 to form an L shape is twisted and bent downward. The other contact 32 includes a pair of tab contacts 33*c*–33*d*, coupling section 36, and solder connection terminal 38, and is essentially the same as the first contact 31; however, it differs in that tab contacts 33*c* and 33*d* are twisted upward on both sides and the solder connection terminal 38 extends out and bends to the right after which it is bent downward. Fashioned in such a way, tab contacts 33*a* to 33*d* of both contacts 31, 32 are arranged so they are on the same planes with respect to one another and coupling sections 35, 36 as well as solder connection terminals 37, 38 are arranged so that it is possible for them to avoid short circuiting each other.

Figure 2:
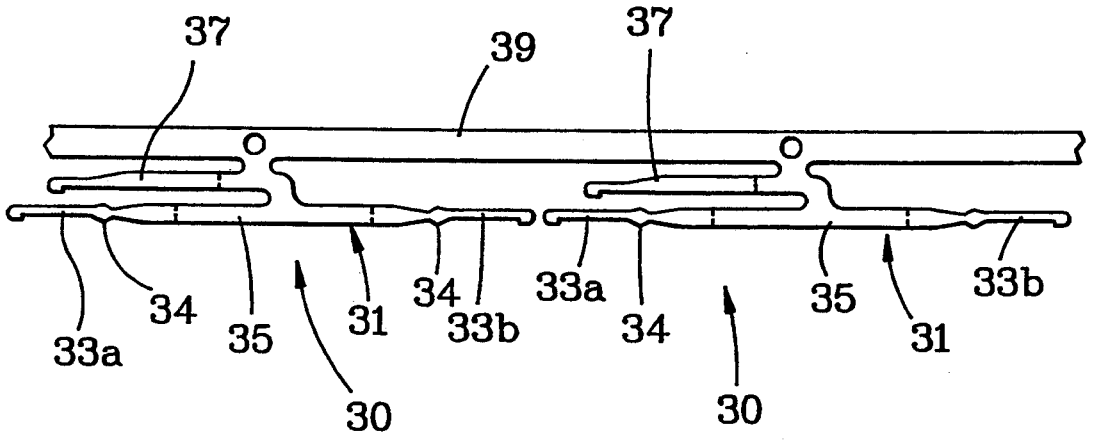
FIG. 2 shows a metal blank for forming the electrical contact according to the present invention that can be used in the electrical connector shown in FIG. 1.
Figure 7:
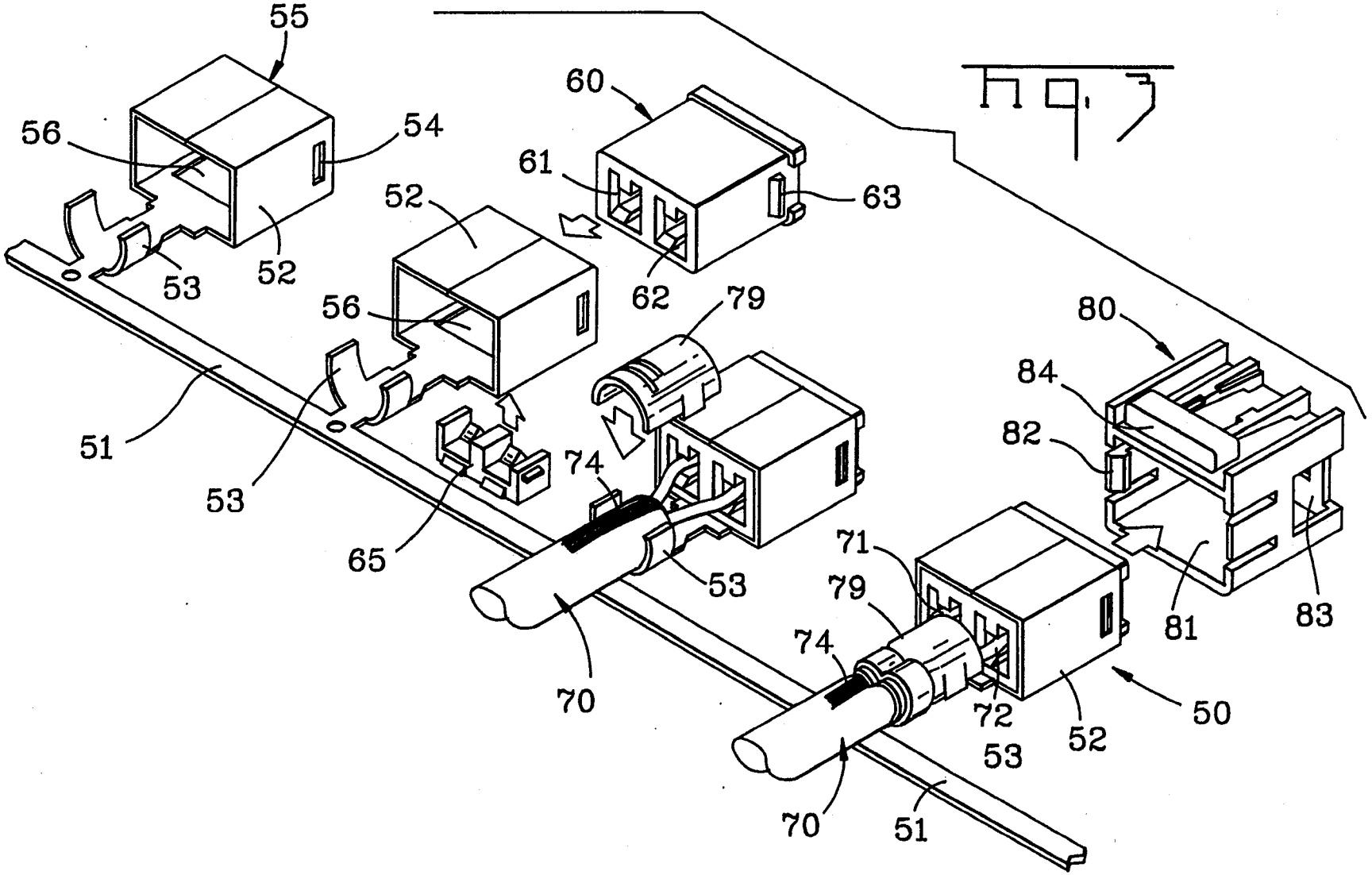

FIG. 2 is utilized to explain the manufacturing process for making terminals 30 used in the electrical connector 10 shown in FIG. 1. As evident in FIG. 2, terminals 30 are manufactured by a stamping and forming process from a sheet of suitable conductive metal, usually of a copper alloy. That is, the terminal is formed from a metal sheet with coupling section 35 in a straight line with and substantially parallel to carrier strip 39 and tab contact 33*a* and 33*b* on both ends. Solder connection terminal 37 is formed in substantially a straight line and connected with the approximate center of coupling section 35. By twisting or bending the coupling section 35 and the solder connection terminal 37 at the positions indicated by the dotted lines, contact 31 as shown in FIG. 1 is formed. Note that contacts 31 and 32 can be manufactured with the same stamping and forming processes, one just has to be turned upside down with respect to the other in order to be used. Of course, solder connection terminals 37,38 must be bent in opposite directions so that both are extending downwards. With this method it is possible to use extremely narrow metal sheets (or metal stock) and, as can be clearly seen when compared to FIG. 5C, it is also possible to achieve very high efficiencies with the amount of metal sheet that has to be scrapped greatly reduced.

Next grounding contact 40 will be explained with reference to FIG. 1. Grounding contact 40 is shown only for use in compartment 21 but grounding contact can also be used in compartment 22 in the same manner. The grounding contact is comprised of a flat base section 41 with a pair of flexible flag contact members 42, 43 extending upwards on either side and toward the front end thereof. In approximately the center of the base section 41 of grounding contact 40, a flexible lance 44 is cut out and pushed down, while a ground terminal 45 and a pair of legs 46, 47 project from the rear edge thereof. When grounding contact 40 is inserted into compartments 21, 22 the lance 44 will latch onto the edge of opening 25 in the lower surface of compartment 21 and be latched therein while grounding terminal 45 and legs 46, 47 will extend through the openings (not shown) formed in the rear wall of cap housing 20. These grounding terminals 45, if bent down behind the rear wall of cap housing 20, could, for example, be inserted into through holes in a printed circuit board (not shown) and soldered along with solder connection terminals 37, 38 of contacts 31, 32. In addition, legs 46 and 47 could be bent flat along the rear wall of cap housing 20 so as to firmly fasten grounding contact 40 within compartment 21 of cap housing 20.

FIG. 3 is a perspective view showing the manufacturing process for plug connector 50 to be inserted into compartments 21, 22 and connected with cap connector 10 shown in FIG. 1. First, shield case 55 is formed of one piece with cable clamping section 53 and box enclosure 52 at intervals along carrier strip 51 of metal sheet. Inner housing 60 including two contact cavities 61, 62 is inserted into shield case 55 from the rear. Projecting tab 63 on the side surface of the inner housing 60 fits into the opening 54 made in the side of box enclosure 52 to firmly secure the housing therein. Opening 56 is formed in the bottom of shield case 55 so that double lock member 65 can be inserted therethrough for purposes to be described below.

Next, two conductive wires 71, 72 from shielded cable 70 terminated with terminals as described below, are inserted into contact cavities 61, 62 of inner housing 60 along with receptacle contacts thereof. By then inserting the double lock member 65 described above into housing 60, each terminal is locked within cavity 61 and 62 respectively. Subsequently, the end of shielded cable 70 is covered with semi-cylindrical outer ferrule 79 and a clamping procedure conducted with clamping section 53 to seal and clamp shielding braid 74. With this process, shielded cable 70 with terminals is inserted and fixed in inner housing 60 which is firmly locked in shield case 55.

Finally, plug housing 80 is placed over shield case 55 and plug connector 50 is completed. Plug housing 80 has a pair of latch arms 82 designed to catch and maintain inner housing 60 within shield case 55 when it is inserted into receptacle compartment 81. It also has opening 83 formed on both sides and latch arm 84 formed on the upper surface of outer housing 80 for mating with cap housing 20.

When a plug connector 50 assembled in this way is inserted into compartments 21, 22 of cap connector 10, because the side surfaces of shield case 55 are exposed due to openings 83, the flexible flag contact members 42, 43 of grounding contact 40 within compartments 21, 22 of cap connector 10 electrically engage shield case 55.

Figures 4A, 4B, 4C, 4D, 4E, 4F:
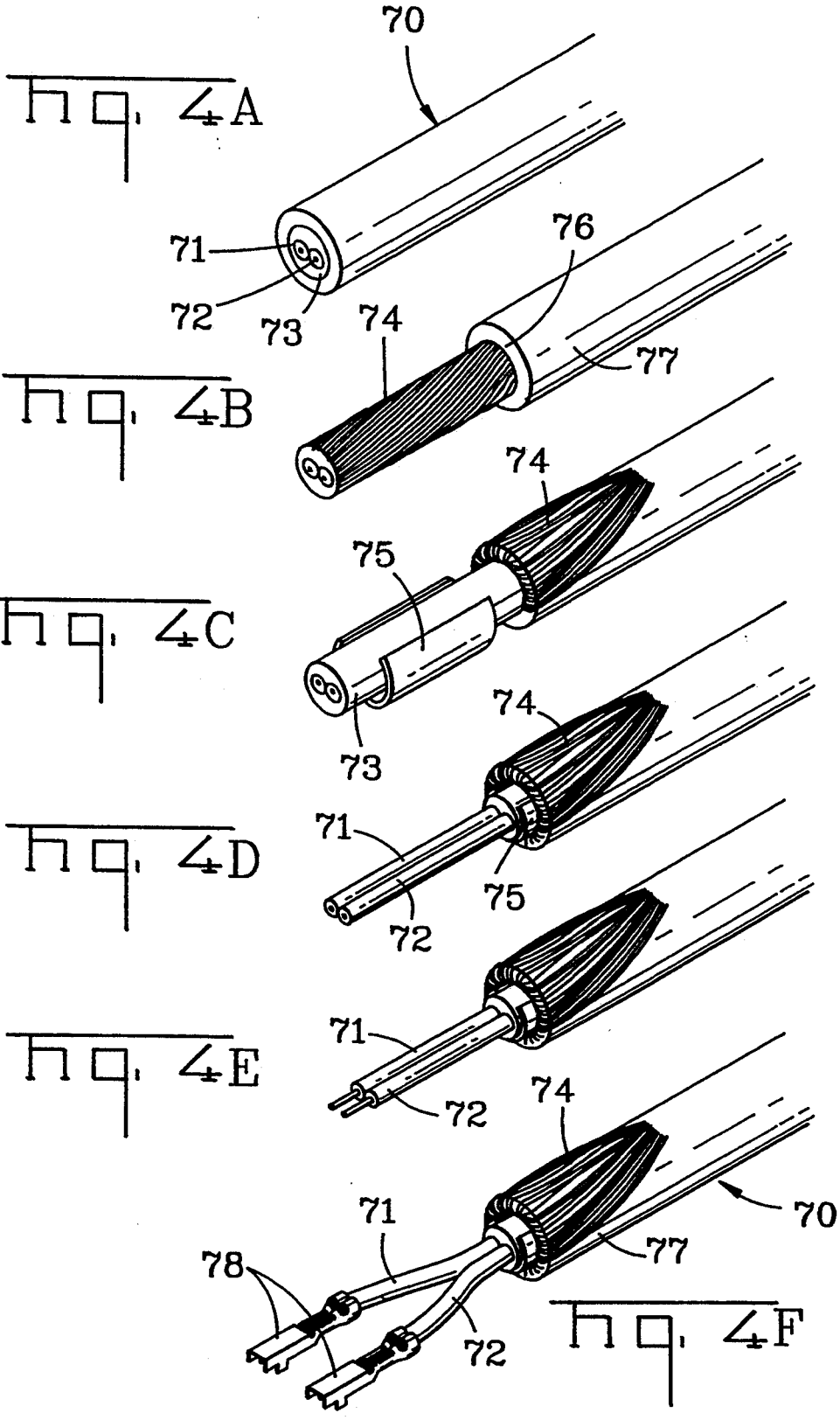
FIGS. 4A–F show the steps for terminating shielded cable to be connected to the plug connector shown in FIG. 3.

FIGS. 4A to F show the terminal processing procedure for shielded cable 70 to form the data bus cable 100 used with plug connector 50 of FIG. 3. This shielded cable has two insulated conductive wires 71, 72 at its core. Around these wires is an inner jacket 73, cross-wound shielding braid 74, an aluminum film 76, and an outer jacket 77. One end of this shielded cable is shown in FIG. 4A. FIG. 4B shows this cable with a fixed length of the outer jacket 77 and the aluminum film 76 removed. In FIG. 4, the shielding braid 74 is peeled back and a metal inner ferrule 75 with a C-shaped cross-section is placed over the inner jacket 73 and forced down toward and under the shielding braid 74 between the shielding braid and the inner jacket. Then, as is shown in FIG. 4D, a fixed length of the inner jacket 73 is cut away to expose insulated wires 71 and 72. The insulating covering wires 71, 72 is then removed from the wires to expose the conductive cores, (FIG. 4E). Finally, terminal receptacle contacts 78 are affixed to or connected with the exposed wires according to the usual methods as shown in FIG. 4F.

Shielded cable 70 processed with the method shown in FIGS. 4A to F can be connected to the plug connector 50 in the manner described above with reference to FIG. 3. When this is done, the shielding braid 74 of shielded cable 70 is held between the outer ferrule 79 and inner ferrule 75 as described above and clamped with the pressure barrel 53. With this method, shielding braid 74 is firmly connected to the shield case 52.

The inter-connection of plug connector 50 and cap connector 10 configured as described above will now be explained. When plug connector 50 connected to shielded cable 70 is inserted into compartments 21, 22 of insulation housing 20 of the cap connector 10, contacts 78 inserted and held in contact cavities 61, 62 of inner housing 60 of plug connector 50, are connected with tab contacts 33*a*, 33*b* and 33*c*, 33*d* of contacts 31, 32 of cap connector 10. At the same time, the flexible flag contacts 42, 43 of grounding contact 40 make contact with the sides of box enclosure 52 of shield case 55 of plug connector 50. With this arrangement, not only is the signal circuit formed including wires 71, 72, receptacle contacts 78, and contacta 31, 32 but also the shield and ground circuit including the shielding wire 74 of shielded cable 70, shield case 55 and grounding contact 40 is also formed. In addition, the latch arm 84 of plug housing 80 of the plug connector 50 latches with a catch (not shown) formed on the upper inner surface of compartments 21, 22 of cap housing 20 of the cap connector 10.

Above, a detailed description of a practical example of the electrical contact 30 of the present invention and the electrical connector 10 used is given with reference to the attached figures. This invention, however, is in no way limited to the present example and there are, of course, many other variations and transformations of the structure and form of the contacts and connectors possible based on this same essential concept.

As can be understood from the above explanation, the contacts of the present invention possess a unitary structure which can be stamped from metal sheet in substantially a straight line and formed with a pair of separated tab contacts connected via a coupling section with approximately right-angled bending. Consequently, it is possible to manufacture electrical contacts inexpensively using metal strips of extremely narrow width thereby reducing scrap to a minimum.

Also, the electrical connector of the present invention uses a pair of contacts in an insulation housing, and, because each of the contacts is formed with the tabs twisted up or down in opposite directions, the tab contact section can be formed so as to be on the same plane while there is no chance of mutual contact between the coupling sections. For these reasons, it is now possible to manufacture and assemble electrical connectors more easily than with past assembly processes. Also, the tabs of each contact can be twisted and formed in the same direction but just turned upside down with respect to one another for use; only the solder connection terminals have to be bent in opposite directions.

I claim:

1. An electrical connector, comprising:

a dielectric housing having front open end compartments;

a grounding contact including a base section extending along an inner surface of each said compartment and a grounding terminal extending through a rear wall of said housing, flexible contact members extending outwardly from said base section and along other inner surfaces of said compartments substantially normal to said inner surface, securing means provided by said grounding contact and said housing securing said grounding contact in said compartments; and electrical terminal means in the form of a pair of electrical contacts each including a coupling section having a pair of separated tab contacts and a connection terminal, said tab contacts of each electrical contact extending through the rear wall of said housing and into each respective compartment such that the tab contacts in each compartment are disposed in the same plane and the coupling sections of the contacts extend parallel to each other along the rear wall while the connection terminals extend substantially normal to said coupling sections.

2. An electrical connector as claimed in claim 1, wherein said flexible contact members are flag shaped.

3. An electrical connector as claimed in claim 1, wherein said securing means include a lance in said base section disposed in an opening in said housing.

4. An electrical connector as claimed in claim 3, wherein said base section includes legs extending through the rear wall and bent therealong.

5. An electrical connector as claimed in claim 1, wherein said tab contacts are twisted in the same direction relative to the coupling section so that the tab contacts extend normal with respect to the coupling section and parallel with respect to each other.

6. An electrical connector as claimed in claim 5, wherein the tab contacts of each of the electrical contacts are twisted so as to be oriented opposite to each other and the connection terminals of the electrical contacts extend in the same direction parallel to each other.

7. An electrical connector, comprising:

a shield member including a termination section for termination to a shielding member of an electrical cable;

an inner dielectric housing having contact-receiving cavities in which electrical contacts electrically connected to electrical wires of the electrical cable are to be secured, said inner housing being positionable within said shield member, securing means provided by the shield member and the inner housing securing the inner housing within the shield member; and an outer dielectric housing disposed over said shield member including latch members for latching engagement with said shield member to secure said outer housing thereon and another latch member for latching the connector to a matable connector, said outer housing having an opening exposing a section of said shield member for engagement with a ground contact of the matable connector.

8. An electrical connector as claimed in claim 7, wherein said termination section is a U-shaped member along which the electrical cable extends and a semi-cylindrical ferrule member is disposed within the U-shaped member and clamped therein by the U-shaped member.

9. An electrical connector as claimed in claim 7, wherein said outer housing has another opening exposing another section of said shield member.

10. Matable electrical connectors, comprising:

a cap connector including a cap housing having at least one compartment, a grounding contact extending along an inner surface of said compartment and including a grounding terminal extending outwardly from said cap housing and a flexible contact member extending along another inner surface of said compartment, spaced electrical contacts having tab contacts extending through a rear wall of said cap housing into said compartment and a connection terminal extending outwardly from said cap housing;

a plug connector including a shield member having a termination section for termination onto an electrical cable, an inner housing disposed in said shield member and having contact-receiving cavities in which receptacle contacts connectable to electrical wires of the electrical cable are to be disposed, an outer housing secured onto said shield member including an opening exposing a section of the shield member, and a latch member on said outer housing latchable with said cap housing when said plug connector is positioned within said compartment with said receptacle contact electrically engaged with said tab contacts and said flexible contact member electrically engaged with said section of said shield member.

11. Matable electrical connectors as claimed in claim 10, wherein said cap housing has another compartment, each of said electrical contacts having a coupling section including another tab contact extending through the rear wall of the cap housing and into the other compartment, the coupling sections extending parallel to each other along the rear wall and the tab contacts being disposed in the same plane, each coupling section having the connection terminal extending normally therefrom.

12. An electrical contact comprising a planar coupling section having tab-contacts at either end, said tab contacts being twisted and bent to a perpendicular position with respect to said coupling section and substantially planar to each other, and said coupling section having an integral connection terminal midway between said tab contacts.

13. An electrical contact as in claim 12, wherein said connection terminal is bent so as to be perpendicular to the plane of said coupling section.

* * * * *